US006475119B2

(12) United States Patent
Chow

(10) Patent No.: US 6,475,119 B2
(45) Date of Patent: Nov. 5, 2002

(54) DEFORMABLE BALL

(75) Inventor: Andrew E. Chow, Champlin, MN (US)

(73) Assignee: Lee Communications, Inc., Plymouth, MN (US)

( * ) Notice: Subject to any disclaimer, the term of this patent is extended or adjusted under 35 U.S.C. 154(b) by 14 days.

(21) Appl. No.: 09/812,732

(22) Filed: Mar. 20, 2001

(65) Prior Publication Data

US 2001/0053733 A1 Dec. 20, 2001

Related U.S. Application Data

(63) Continuation of application No. 09/590,560, filed on Jun. 9, 2000, now Pat. No. 6,224,513.

(51) Int. Cl.[7] ..... A63B 23/16; A63B 37/06
(52) U.S. Cl. ..... 482/49; 473/601
(58) Field of Search ..... 482/22, 44, 45, 482/49, 50, 20, 148; 273/63 E, 58 F, 584; 446/267, 369; 473/601

(56) References Cited

U.S. PATENT DOCUMENTS

| | | | | | |
|---|---|---|---|---|---|
| 3,601,923 | A | * | 8/1971 | Rosenberg | 482/48 |
| 4,929,211 | A | * | 5/1990 | Resnick et al. | 482/49 |
| 4,952,190 | A | * | 8/1990 | Tarnoff et al. | 446/267 |
| 5,891,000 | A | * | 4/1999 | Phillips | 482/49 |
| 5,951,420 | A | * | 9/1999 | Talarico et al. | 473/601 |

* cited by examiner

*Primary Examiner*—Stephen R. Crow
(74) *Attorney, Agent, or Firm*—Nawrocki, Rooney & Silvertson, P.A.

(57) ABSTRACT

A therapeutic hand exerciser includes a resilient core and a fabric exterior lining. The core is soft, pliable and smooth when squeezed. The soft smooth feel of a segmented polyurethane fabric, such as LYCRA®, also provides a more pleasurable feel than a rubber cover. The addition of the thermo plastic urethane (TPU) lining prevents the core material from passing through the fabric cover.

15 Claims, 2 Drawing Sheets

DEFORMABLE BALL

This application is a continuation application of U.S. patent application Ser. No. 09/590,560, filed Jun. 9, 2000, now U.S. Pat. No. 6,224,513 and entitled "Therapeutic Squeeze Ball".

TECHNICAL FIELD OF THE INVENTION

The present invention relates generally to hand exercisers and in particular the present invention relates to a therapeutic squeeze ball.

BACKGROUND OF THE INVENTION

Hand exercisers are available in a variety of styles and designs. In general hand exercisers are intended to allow a user to contract the fingers of a hand to exercise the muscles of the hand. Exercising the hand can be useful for physical therapy to strengthening the hand after an injury has been sustained. Hand exercisers can also be helpful in relieving stress.

Squeeze balls are a type of hand exerciser that provides a ball that can be squeezed by contracting fingers around the ball. Different types of squeeze balls have been produced. One type of squeeze ball used small beads, sand or beans contained in a fabric or rubber-type shell. The contents of these balls are not very resilient and do not provide an appealing texture. An alternate ball construction used a silicon material contained in a latex or rubber shell. Often two latex shells are used to prevent oil from the silicon material from leaking. Although fabric material can be desired because of its "feel", silicon material in fabric shells are typically not used because oil from the silicon material can leak through the weaving of the fabric. Also, it is common for people to have allergic reactions to latex material.

For the reasons stated above, and for other reasons stated below which will become apparent to those skilled in the art upon reading and understanding the present specification, there is a need in the art for a silicon based squeeze ball that has a fabric-type exterior shell.

SUMMARY OF THE INVENTION

The above-mentioned problems with squeeze balls and other problems are addressed by the present invention and will be understood by reading and studying the following specification.

In one embodiment, a hand exerciser comprises a silicon gel core, a porous fabric shell covering an exterior surface of the silicon gel core, and a non-porous urethane lining located between the porous fabric shell and the silicon gel core.

In another embodiment, a hand exerciser comprises a silicon diffused polyurethane core, a segmented polyurethane fabric shell covering an exterior surface of the silicon diffused polyurethane core, and a thermo plastic urethane layer adhered to the segmented polyurethane fabric and located between the segmented polyurethane fabric shell and the silicon diffused polyurethane core.

In yet another embodiment, a method of making a hand exerciser comprises forming a silicon gel core, adhering a non-porous urethane lining to a porous fabric to form a shell material, fabricating the shell material into a shell having a shape substantially identical to an exterior surface of the silicon gel core, and encasing the silicon gel core in the shell.

An alternate method of making a hand exerciser comprises molding a diffused polyurethane material to form a spherical core, adhering a thermo plastic urethane layer to a segmented polyurethane fabric to form a shell material, die cutting the shell material into a plurality of shell sub-components, sewing the plurality of shell sub-components together to form a shell having a spherical shape, and encasing the spherical core in the shell.

DETAILED DESCRIPTION OF THE INVENTION

In the following detailed description of the preferred embodiments, reference is made to the accompanying drawings that form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims.

Figure 1:
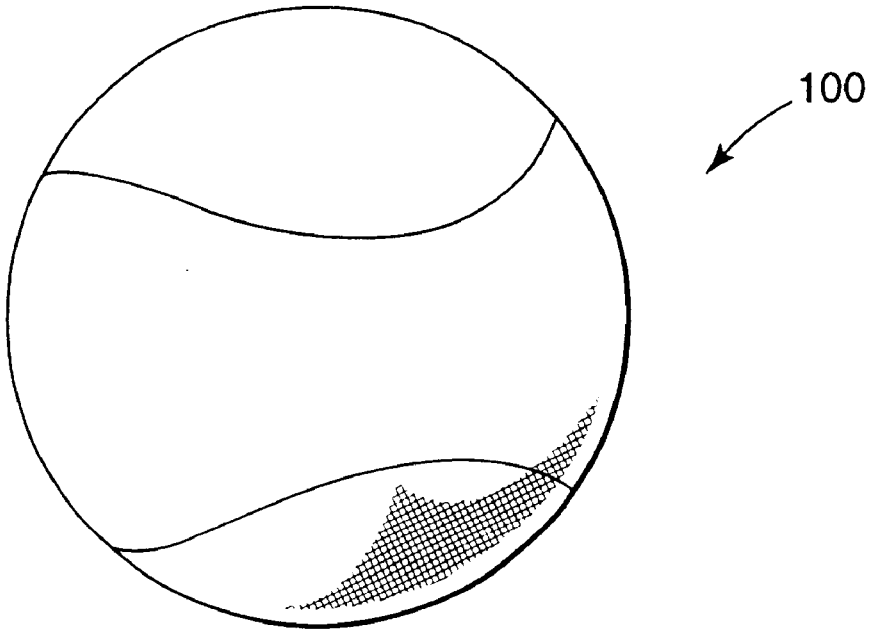
FIG. 1 is a perspective view of one embodiment of a squeeze ball of the present invention.

Referring to FIG. 1, a perspective view of one embodiment of a squeeze ball 100 of the present invention is provided. The squeeze ball, in its normal state is shaped as a round, or spherical ball. In the illustrated embodiment, the ball has stitching to imitate the look of a baseball. It will be appreciated with the benefit of the present specification that squeeze devices can be fabricated in numerous other geometric shapes, and the present invention is not limited to round balls.

The squeeze ball illustrated in FIG. 1 has a core comprised of a gel material. In one embodiment, the gel material is Diphenylmethane-4,4'-Diisocyanate. The gel is available from BASF Headway Polyurethanes (Taiwan) Co., Ltd., No. 11, Jen Cheng Road, Hsinchu Industrial Park, Huko Heian, Hsinchu, Taiwan as a silicon polyurethane gel material referred to under the trade name I-126. It will be appreciated by those skilled in the art that other silicon materials can be used without departing from the invention.

The silicon material is covered in a fabric material containing LYCRA®. LYCRA® was originally developed as a replacement for rubber, and has an ability to stretch up to about 7 times its original length—and then snap back to its starting size with no loss to its spring. There is really no such thing as a commercially available fabric made entirely of LYCRA®. It's never used alone, but is always combined with another fiber (or fibers), both natural or man-made. As little as 2 percent LYCRA® is enough to improve a woven fabric's movement and its knack for holding its shape.

LYCRA® is a man-made elastomeric fiber, invented and produced by DuPont Corporation. Generically, these kind of fibers are known as spandex in the US and Canada and as elastane in Europe. LYCRA® is a "segmented polyurethane." While LYCRA® appears to be a single, continuous thread, it is actually a bundle of tiny filaments. It's this unique molecular structure that gives LYCRA® its built-in, lasting elasticity. Stretch it four to seven times its original length, yet the fiber still returns to its starting size once the tension is released.

To prevent the silicon material, oil, or other byproduct of the silicon material from passing through pores in the fabric material, the inside surface of the fabric is coated with a layer of thermo plastic urethane (TPU) material. The TPU layer prevents the gel from passing through the fabric without making the fabric stiff and inflexible. An added advantage of the TPU material is that a sandwich of TPU and fabric is more easily die cut than the fabric without a layer of TPU attached thereto. The TPU layer can be adhered to the fabric directly or with an adhesive. In one embodiment, the TPU layer is a separate sheet having an approximate thickness of 0.3 mm and adhered to the fabric using heated rollers to thermally bond the two materials. It will be appreciated that a thin pliable layer of adhesive could alternatively be used.

Figure 2:
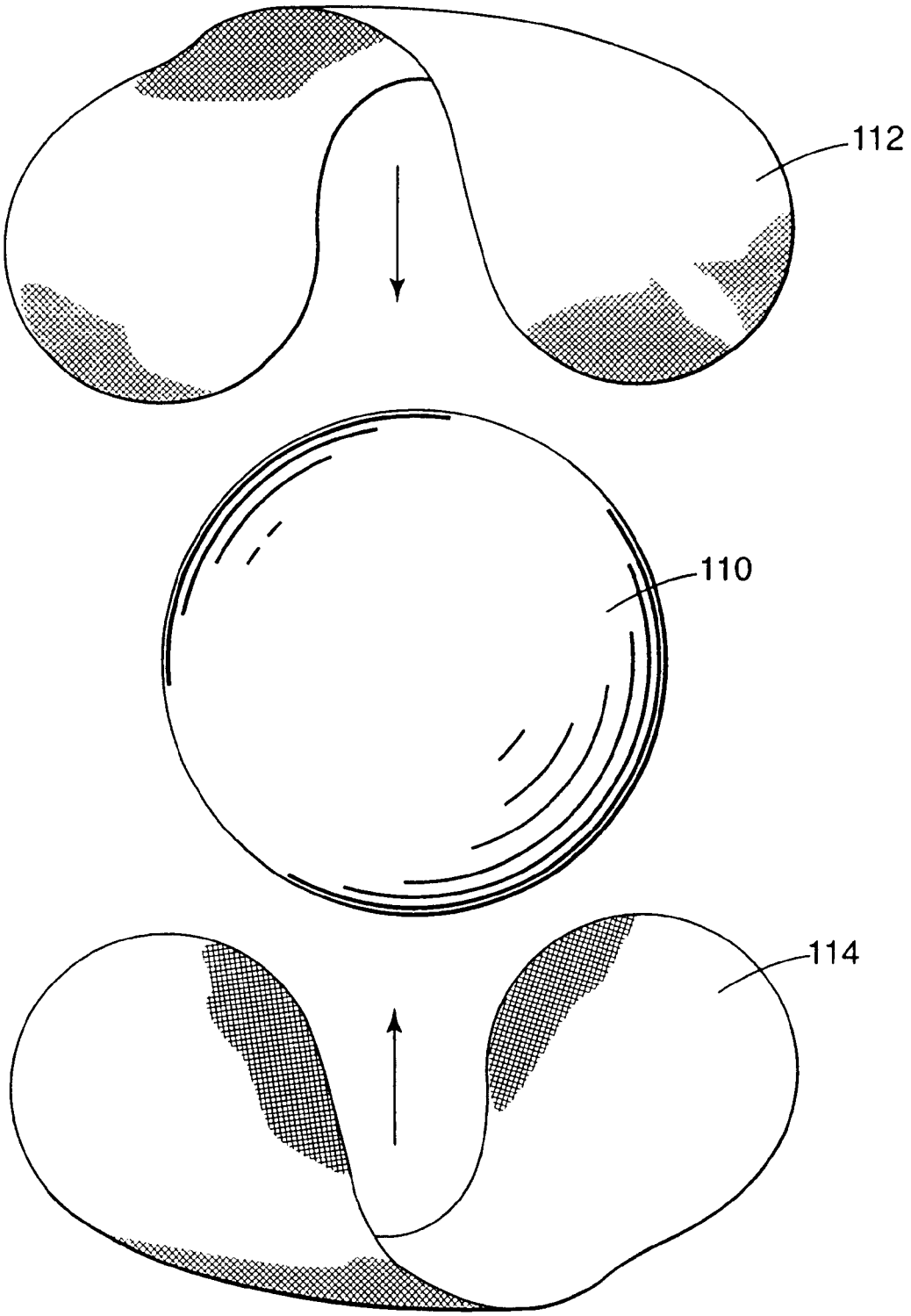
FIG. 2 an exploded view of the squeeze ball of FIG. 1.

Referring to FIG. 2, one method of manufacturing a squeeze ball is described. First a polyurethane gel is mixed and dispensed into a mold to form a spherical gel ball 110. The gel balls are cured and removed form the mold. A layer of talcum powder can be used to make handling easier. The gel balls are allowed to cool for a predetermined time, for example, 24 hours.

Figure 3:
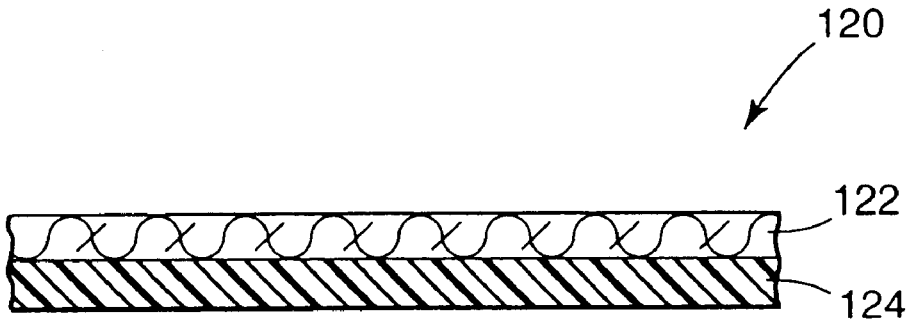
FIG 3 is a cross-section view of a shell material of the present invention.

A layer of TPU is applied to the fabric material. See FIG. 3 illustrating a layer of fabric 124 and a layer of TPU 122 adhered together to form a TPU supported shell material 120. The TPU supported material is die cut into pieces 112 and 114 (sub-components for the fabric shell) resembling a figure-eight. The two die cut pieces of fabric are stitched together using a Nylon thread to form a pouch (shell) with an opening sufficient to insert the gel ball 110, for example, a one inch opening can be left in the fabric. A gel ball is then inserted into the fabric pouch and the cover is sewn closed using a double stitch.

It has been determined that the present invention allows for improved screen-printing of the fabric material. That is, some indicia is often printed on squeeze ball products for marketing purposes. Printing on prior products can result in a inferior image because of residue from the ball core that penetrates through the exterior fabric. The present invention provides a barrier between the core and the fabric material. As such, the resultant image of a screen-printing process conducted on the fabric of the present invention is visually improved.

CONCLUSION

The above described squeeze ball provides a therapeutic hand exerciser that includes the benefit of a resilient core and the feel of a fabric exterior lining. The core is soft, pliable and smooth when squeezed. This provides a more pleasurable feel than beads, or the like. The soft smooth feel of a segmented polyurethane fabric, such as LYCRA®, also provides a more pleasurable feel than a rubber cover. The addition of the TPU lining prevents the core material from passing through the fabric cover.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. A hand exerciser comprising:

a silicon gel core;

a porous fabric shell covering an exterior surface of the gel core; and a non-porous lining located between, and adhered to, the porous fabric shell and the silicon gel core.

2. The article of manufacture of claim 1 further comprising indicia printed on the porous fabric shell.

3. The article of manufacture of claim 1 wherein the non-porous lining comprises a thermo plastic urethane layer adhered to the porous fabric shell.

4. The article of manufacture of claim 1 wherein the porous fabric shell comprises a segmented polyurethane fabric.

5. The article of manufacture of claim 1 wherein the gel core comprises a diffused polyurethane material.

6. The article of manufacture of claim 1 wherein the gel core is a substantially spherical ball.

7. The article of manufacture of claim 1 wherein the fabric shell comprises a plurality of fabric components sewn together.

8. A hand exerciser comprising:

a silicon core;

a fabric shell covering an exterior surface of the silicon core;

a urethane layer adhered to the fabric shell and located between the fabric shell and the silicon core; and indicia printed on the fabric shell.

9. The article of manufacture of claim 8 wherein the silicon core is a diffused polyurethane silicon core.

10. The article of manufacture of claim 8 wherein the fabric shell is a segmented polyurethane fabric.

11. The article of manufacture of claim 8 wherein the silicon core is a substantially spherical ball.

12. The article of manufacture of claim 8 wherein the fabric shell comprises a plurality of fabric components sewn together.

13. A deformable ball comprising:

a spherical ball core comprising a silicon diffused polyurethane material;

a fabric covering an exterior surface of the spherical ball core; and a urethane layer adhered to the fabric and located between the fabric and the spherical ball core.

14. The deformable ball of claim 13 further comprising indicia printed on the porous fabric shell.

15. The deformable ball of claim 13 manufactured using a method comprising:

molding a diffused polyurethane material to form a spherical ball core;

adhering the urethane layer to the fabric to form a shell material;

die cutting the shell material into a plurality of shell sub-components;

sewing the plurality of shell sub-components together to form a shell having a spherical shape; and encasing the spherical ball core in the shell.

* * * * *